US007396185B2

(12) United States Patent
Rossi

(10) Patent No.: US 7,396,185 B2
(45) Date of Patent: Jul. 8, 2008

(54) METHOD FOR REPAIRING A CRACK IN A RECREATIONAL COURT OR SURFACE

(75) Inventor: James Christopher Rossi, Sparks, MD (US)

(73) Assignee: Guardian Crack Repair, LLC, Baltimore, MD (US)

( * ) Notice: Subject to any disclaimer, the term of this patent is extended or adjusted under 35 U.S.C. 154(b) by 0 days.

(21) Appl. No.: 11/633,176

(22) Filed: Dec. 4, 2006

(65) Prior Publication Data

US 2007/0147958 A1 Jun. 28, 2007

Related U.S. Application Data

(62) Division of application No. 10/894,972, filed on Jul. 20, 2004, now Pat. No. 7,168,887.

(51) Int. Cl.
*E01C 21/00* (2006.01)
*B32B 5/26* (2006.01)

(52) U.S. Cl. ..... 404/75

(58) Field of Classification Search ..... 404/31–49, 404/72, 75

See application file for complete search history.

(56) References Cited

U.S. PATENT DOCUMENTS 3,581,631 A 6/1971 Rozendaal
3,663,350 A 5/1972 Stokes
3,707,901 A * 1/1973 Bynum et al. ..... 404/71
3,932,051 A 1/1976 Cleary
4,540,311 A * 9/1985 Leach ..... 404/72
4,744,193 A 5/1988 Hatsuzaki
4,793,162 A 12/1988 Emmons
5,185,013 A 2/1993 Martin
5,190,811 A 3/1993 Rossi
5,393,559 A * 2/1995 Shoesmith et al. ..... 427/136
5,464,304 A 11/1995 Dittmar
5,513,925 A 5/1996 Dempsey
5,630,677 A 5/1997 Barroso
5,711,834 A 1/1998 Saito
5,749,674 A 5/1998 Wilson
6,074,128 A 6/2000 Marino
6,123,879 A * 9/2000 Hendrix et al. ..... 264/31
6,450,729 B1 9/2002 Clapp
6,786,674 B1 9/2004 Hanks

* cited by examiner

*Primary Examiner*—Raymond W Addie
(74) *Attorney, Agent, or Firm*—Scott R. Cox

(57) ABSTRACT

A process for repairing a crack in a recreational court or surface comprising cleaning the crack to remove loose material, filling the crack with a crack filling material, such as a flexible sealant material which adheres to the edges of the crack and securely seals the crack, applying a laminate to the recreational surface and to the exposed sealant material to completely cover the crack, wherein the laminate comprises a waterproof adhesive applied to a flexible material, and securing a polyester flexible fabric to at least the edges of the laminate using an adhesive material.

20 Claims, No Drawings

METHOD FOR REPAIRING A CRACK IN A RECREATIONAL COURT OR SURFACE

CROSS REFERENCE TO RELATED APPLICATION

This application is a divisional application of application Ser. No. 10/894,972, filed on Jul. 20, 2004, now U.S. Pat. No. 7,168,887.

BACKGROUND OF INVENTION

This invention relates to a method for repairing a crack, particularly in a recreational court or surface.

A variety of methods exist for repairing cracks in surfaces, such as roadways, pavements and other concrete or asphalt surfaces, and particularly for recreational courts or surfaces, such as tennis courts, outdoor basketball courts, volleyball courts, running tracks and multi-sport play courts. Such cracks are a significant problem, especially in those areas of the country where there are significant variations in temperature throughout the year. The conventional process for repairing cracks in recreational courts or surfaces requires cleaning debris out of the cracks and filling the cracks with a crack filler material which solidifies to a hardened state. Prior to hardening, this crack filling material is leveled to the level of the recreational court or surface.

Unfortunately, crack repairs made using this conventional process are only a temporary fix. Continued maintenance of the recreational court is necessary because of the formation of new cracks or the further deterioration of the earlier crack caused by changes in temperature and moisture in the environment as well as ground movement or settling and problems with the construction of the court or surface. Cracks repaired using this conventional process often tear open again as the asphalt or concrete pavement expands or contracts caused by temperature changes, moisture level increases, ground movement or settling, or the freeze and thaw of the surrounding ground.

A more complex process for repairing cracks in recreational courts or surfaces, particularly tennis courts, requires covering the filled crack with a slip-sheet, i.e. a non-adhering material which isolates the crack from the surrounding environment. This process requires the crack to be cleaned and filled with a hardened crack filler to the level of the surrounding pavement or recreational court. A slip-sheet is then secured, usually by an adhesive, to the surface of the recreational court, completely covering the filled crack. The top surface of this slip-sheet, which is applied over the crack, is required not to adhere to other materials which cover the slip-sheet. Another layer or layers of material, such as one or more fiberglass sheets, are then placed over the non-adhering surface of the slip-sheet and are secured at least at their peripheral edges to the pavement or recreational court. By this method, the top surface of the slip-sheet is isolated from the remaining materials, enabling the slip-sheet to expand and contract with the court or surface without putting stress on the crack repair. Early slip-sheet methods are disclosed in U.S. Pat. Nos. 3,663,350 and 3,932,051.

Another method of crack repair using a slip-sheet utilizes a tape material with a shiny outer surface, prepared from polyethylene, Mylar, Teflon or other such materials, as disclosed in U.S. Pat. No. 6,450,729. An adhesive tape, such as duct tape, which has a non-adhering polyethylene top surface, is one example of a slip-sheet of this invention.

In an alternative method, which is disclosed in U.S. Pat. No. 5,464,304, a liquid waterproofing material is applied directly over the filled crack. This liquid waterproofing material dries with a non-adhering top surface that isolates the crack from additional materials placed over the non-adhering surface. Over this non-adhering surface are secured several fabric layers by use of acrylic binders. The key step in this process, however, is the crack isolation step produced by the application of the liquid waterproofing material to the recreational court.

The process of U.S. Pat. No. 5,464,304 is similar to that of U.S. Pat. No. 6,450,729 in that both rely on the application of a non-adhering material to the recreational court or surface over which other materials are placed. Many different types of materials and adhesives may be applied over the slip-sheet or other non-adhering surface to complete the crack repair.

While these processes for filling cracks in recreational courts or surfaces have shown utility, they can be difficult to apply, require an extensive amount of time to cure and still result in problems caused by the recurrence of the cracks.

Accordingly, it is an object of the invention to disclose a method for repairing a crack in a court or surface, particularly a recreational court or surface, which addresses the problems of the prior art. These and other objects can be obtained by the process for repairing a crack in a recreational court or surface that is disclosed in the present invention.

SUMMARY OF THE INVENTION

The present invention is a process for repairing a crack in a recreational court or surface comprising cleaning the crack to remove loose material, filling the crack with a crack filling material, which adheres to and seals the inside edges of the crack, applying a laminate to the recreational surface and to the exposed sealant material to cover the crack completely, wherein the laminate comprises an adhesive secured to one side of a flexible fabric material, wherein the adhesive is secured to the recreational surface and the exposed sealant material, and securing a fabric, preferably a flexible polyester fabric, to at least the edges of the flexible fabric material of the laminate using an adhesive material.

In a further preferred embodiment one or more layers of paint, preferably an acrylic paint, are then applied to the fabric material, exposed laminate and recreational court or surface to complete the repair of the crack in the recreational court or surface.

DETAILED DESCRIPTION

The invention is a method for repairing a crack in a recreational court or surface. The court or surface to be repaired can be formed of any conventional material, such as concrete or asphalt and can be formed into a roadway, driveway, or sidewalk, but preferably is formed as an outdoor recreational court or surface, such as a tennis court, basketball court, volleyball court, running track, multi-sport or play court. In composition conventional recreational courts or surfaces have a certain thickness and are generally placed over a stone base or the ground. Cracks form in these recreational courts as a result of changes in the environmental conditions, such as occur when there are significant changes in the outdoor moisture or temperature, as well as ground movement or settlement and problems with the construction of the court or surface. Cracks formed in the recreational court or surface may have different shapes, widths and lengths and can extend a significant distance or only a small distance into the recreational court.

The first step in the repair of the crack in the recreational court is to clean the crack to remove all loose material and debris. This can be effectively done by brushing, hand removal, high pressure steam and/or the use of air under pressure.

After the crack has been completely cleared of loose debris, a crack filling material is introduced into the crack. In prior art processes this crack filling material was a material which formed a hardened fill material, such as an epoxy binder. In an alternative process, silica, sand, and Portland Cement were mixed together with a liquid to form a wet mortar to fill the crack. This mixture was then allowed to dry to a hardened consistency. These processes, which utilize hardened crack filling agents, may not provide flexibility for the fill material and sometimes permit water to reenter the crack.

While these crack filling materials are still useful for many types of courts, it has been surprisingly discovered that an improved crack filling material is one that can expand and contract with changes in the weather conditions, yet still forms a waterproof bond around the inside edges of the crack to prevent water from entering the crack and causing further deterioration of the existing crack. Any material which can fill the crack completely and securely, yet remain flexible to accommodate expansion and contraction when exposed to changes in temperature and moisture and which also is waterproof, is within the scope of the invention. In one preferred embodiment a flexible polyurethane foam product, such as "Great Stuff" manufactured by Dow Chemical Company, is introduced into the cleaned crack as the flexible sealant material. Sufficient flexible sealant material should be utilized to fill the crack completely up to the level of the surrounding recreational court. After application, the surface of the recreational court should be leveled prior to the complete drying and curing of the sealant material.

After the crack is filled and the crack filling material has been allowed to dry and cure, a laminate is applied to cover completely the crack and the surrounding recreational court or surface. Regardless of whether a flexible sealant is used, it is important that the laminate be flexible to expand and contract with the expansion and contraction of the court. If the crack filling material is a sealant material which is flexible and thus can expand or contract depending on the temperature, it is especially important that this laminate also be flexible to permit expansion and contraction with changes in weather conditions, especially temperature.

The laminate is preferably formed from an adhesive material, preferably waterproof, applied to a flexible fabric material. The adhesive material is preferably a waterproof adhesive which will tightly secure the laminate to the recreational court and to the exposed crack filling material. In one preferred embodiment the adhesive material comprises a waterproof, rubberized asphaltic adhesive.

Secured to the adhesive material is the flexible fabric material. The flexible fabric material can be any material which expands and contracts in coordination with the expansion and contraction of the recreational court. In one preferred embodiment this material may also be waterproof. In addition, this flexible material is preferably elastic. The adhesive portion of the laminate is secured tightly, preferably permanently bonded during production, to one side of this flexible material. In one preferred embodiment the adhesive portion is applied in liquid form to the flexible fabric and when cured, is or becomes bonded, preferably permanently bonded, to the flexible material. Prior to application of the laminate to the surface, the adhesive material is preferably covered by a paper release backing to assist in the storing, utilization and application of the laminate. One preferred laminate material is supplied by Protecto Wrap Company and comprises a construction waterproofing, flexible, adhesive anti-fracture membrane.

Following the filling and curing of the sealant material in the crack, the paper release backing is removed from the adhesive portion of the laminate and the adhesive is applied to and secured firmly to the recreational court and to the exposed sealant material.

In the next step of the inventive process, a flexible fabric is secured to at least the edges of the flexible fabric material of the laminate by an adhesive. This portion of the process differs dramatically from those processes which use a "non-adhering" surface. In the prior art processes the fabrics which cover the "non-adhering" surface are not secured to the "non-adhering" surface. In contrast in the process of the invention, the laminate is secured by adhesive to those fabrics which cover the laminate. In a preferred embodiment the flexible fabric of the invention comprises a flexible polyester fabric, sufficiently sized to cover at least the edges of the laminate. It is secured to at least the edges of the laminate and the surrounding recreational court by use of an adhesive material, preferably a waterproof acrylic or latex adhesive, which is applied to the polyester fabric, prior to or during application. The adhesive is also preferably applied to the edges of the flexible fabric layer, where the edges contact the recreational court or surface. In a preferred embodiment this flexible fabric is secured to portions of recreational court or surface which extends beyond the outer edges of the laminate. In a preferred embodiment the polyester fabric is Bamilex XP403 produced by St. Gobain Technical Fabrics.

After the adhesive on the polyester fabric has dried and cured, the court or surface that has been repaired may be coated with paint, preferably an acrylic paint, with its color coordinated with the color of the non-repaired section of the recreational court or surface that surrounds the repaired crack. Other recreational court or surface materials, such as sand, may be added to the acrylic paint to enhance the coating process.

In operation, the crack in the recreational court or surface is first cleaned and swept clear of debris. The crack is then filled with a crack filling material, preferably a flexible sealant material, and more preferably a polyurethane foam sealant material. A sufficient amount and type of the crack filling material is utilized to adhere completely to the edges of the crack and prevent or limit exposure of the crack to water. After the crack filling material has dried, paper release backing is removed from the adhesive side of the laminate. The adhesive side of the laminate is then applied to the recreational court, completely covering the crack. This adhesive side of the laminate is then pressed firmly in place against the recreational court or surface and the exposed crack filling material. Applied to at least to the edges of the top of the laminate by means of an adhesive material, such as an acrylic adhesive, is the flexible polyester fabric. Finally, the repaired surface is painted to coordinate its color with that of the surrounding recreational surface.

It will be apparent from the foregoing that while particular forms of the invention have been illustrated, various modifications can be made without departing from the scope of the invention.

The invention claimed is:

1. A method for repairing a crack in a recreational court or surface comprising cleaning the crack to remove loose material from within the crack, filling the crack with a flexible crack filling material which adheres to the edges of the crack and accommodates expansion and contraction of said crack, securing a laminate firmly to substantially all portions of the recreational court located under the laminate and also to exposed crack filling material within the crack by use of an adhesive, wherein the laminate comprises the adhesive and a flexible fabric material, and securing a fabric to both the laminate and to portions of the recreational court not covered by the laminate using an adhesive material, wherein the fabric is firmly secured to the laminate and to portions of the recreational court and wherein the laminate and the fabric are flexible to accommodate expansion and contraction of the recreational court or surface.

2. The method of claim 1, wherein the crack filling material comprises a flexible sealant material.

3. The method of claim 1, wherein the laminate comprises a flexible fabric covered with a rubberized, asphaltic adhesive material.

4. The method of claim 1, wherein the adhesive used to secure the fabric to the laminate comprises an acrylic or latex adhesive.

5. The method of claim 1, wherein the fabric secured to the laminate comprises a flexible polyester fabric.

6. The method of claim 1, wherein the crack filling material substantially seals the inner edges of the crack.

7. The method of claim 1, wherein the laminate, prior to application to the surface, further comprises a paper release backing secured to the waterproof adhesive portion.

8. The method of claim 1, further comprising coating the fabric with a paint.

9. The method of claim 8, wherein the paint comprises an acrylic paint.

10. A method for repairing a crack in a recreational court or surface comprising cleaning the crack to remove loose material from within the crack, filling the crack with a crack filing material which adheres to the edges of the crack, wherein said crack filling material comprises a hardened fill material;

securing a laminate firmly to substantially all portions of the recreational court located under the laminate and also to the exposed crack filling material within the crack by use of a waterproof adhesive, wherein the laminate comprises the waterproof adhesive and a flexible fabric material, and securing a fabric to both the laminate and to portions of the recreational court not covered by the laminate using an adhesive material, wherein the fabric is firmly secured to the laminate and to portions of the recreational court and wherein the laminate and the fabric are flexible to accommodate expansion and contraction of the recreational court or surface.

11. The method of claim 10, wherein the laminate comprises a rubberized, asphaltic, adhesive material secured to the flexible material.

12. The method of claim 10, wherein the fabric secured to the laminate comprises a flexible polyester fabric.

13. The method of claim 10, wherein the laminate, prior to application to the surface, further comprises a paper release backing secured to the waterproof adhesive portion.

14. The method of claim 10, further comprises coating the fabric with a paint.

15. A method for repairing a crack in a recreational court or surface comprising cleaning the crack to remove loose material from within the crack, filling the crack with a crack filling material selected from the group consisting of silica, sand, Portland Cement and mixtures thereof, a portion of which adheres to the edges of the crack, securing a laminate firmly to substantially all portions of the recreational surface located under the laminate and also to the crack filling material that is exposed within the crack by use of a rubberized asphaltic adhesive, wherein the laminate comprises the adhesive secured to a flexible fabric material, securing a fabric to the laminate and to portions of the recreational surface not covered by the laminate using an adhesive material, wherein the fabric is firmly secured to the laminate and to portions of the recreational court and wherein the laminate and the fabric are flexible to accommodate expansion and contraction of the recreational court or surface, and coating the fabric with an acrylic paint.

16. The method of claim 15, wherein the fabric secured to the laminate comprises a flexible polyester fabric.

17. The method of claim 15, wherein the laminate, prior to application to the surface, further comprises a paper release backing secured to the waterproof adhesive portion.

18. A method for repairing a crack in a recreational court or surface comprising cleaning the crack to remove loose material from within the crack, filling the crack with a flexible crack filling material that forms a waterproof bond around inside edges of the crack and accommodates expansion and contraction of said crack, securing a laminate firmly to substantially all portions of the recreational surface located under the laminate and also to the crack filling material that is exposed within the crack by use of a rubberized asphaltic adhesive, wherein the laminate comprises the adhesive secured to a flexible fabric material, securing a fabric to the laminate and to portions of the recreational surface not covered by the laminate using an adhesive material, wherein the fabric is firmly secured to the laminate and to portions of the recreational court and wherein the laminate and the fabric are flexible to accommodate expansion and contraction of the recreational court or surface, and coating the fabric with an acrylic paint.

19. The method of claim 18, wherein the fabric secured to the laminate comprises a flexible polyester fabric.

20. The method of claim 18, wherein the laminate, prior to application to the surface, further comprises a paper release backing secured to the waterproof adhesive portion.

* * * * *